US008368615B1

(12) United States Patent
David et al.

(10) Patent No.: US 8,368,615 B1
(45) Date of Patent: Feb. 5, 2013

(54) CONFORMAL FARADAY EFFECT ANTENNA

(75) Inventors: Brock David, San Diego, CA (US); Thomas O. Jones, III, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 311 days.

(21) Appl. No.: 12/861,128

(22) Filed: Aug. 23, 2010

(51) Int. Cl.
*H01Q 15/24* (2006.01)

(52) U.S. Cl. ..... 343/909; 343/787; 343/846

(58) Field of Classification Search ..... 343/909, 343/787, 846, 705, 708, 713
See application file for complete search history.

(56) References Cited

U.S. PATENT DOCUMENTS

| | | | | |
|---|---|---|---|---|
| 4,573,055 | A * | 2/1986 | Wright | 343/787 |
| 4,839,659 | A * | 6/1989 | Stern et al. | 343/700 MS |
| 4,907,010 | A * | 3/1990 | Wright | 343/787 |
| 6,943,731 | B2 * | 9/2005 | Killen et al. | 343/700 MS |
| 7,689,068 | B1 * | 3/2010 | Wang et al. | 385/6 |
| 2002/0097115 | A1 * | 7/2002 | Umemoto et al. | 333/202 |
| 2010/0060388 | A1 * | 3/2010 | Ueda | 333/236 |
| 2010/0171667 | A1 * | 7/2010 | Knudsen | 343/702 |
| 2010/0277381 | A1 * | 11/2010 | Smolyaninov et al. | 343/713 |

OTHER PUBLICATIONS

Batchelor, JC, "Microstrip Antennas on Ferrites", 10th Int. Conf. on Antennas and Propagation, Apr. 14-17, 1997, Conf. Pub. No. 436.

* cited by examiner

*Primary Examiner* — Jason M Crawford
(74) *Attorney, Agent, or Firm* — Ryan J. Friedl; Kyle Eppele

(57) ABSTRACT

The device, a conformal antenna, includes an antenna element directly coupled to a layer of gyrotropic material and means for creating a magnetic field, the magnetic field having a component substantially perpendicular to, and passing through, the layer of gyrotropic material and the antenna element. The gyrotropic material may be at least partially disposed on a ground plane and may comprise a material such as yttrium iron garnet. The means for creating a magnetic field can be located within the layer of gyrotropic material and may comprise at least one external magnet. The reflective metal ground plane can be the outer surface of a vehicle. The antenna element could have a dipole antenna configuration, and can produce a wave that is linearly polarized. The operation of the device may be at or above the resonant frequency of the gyrotropic material.

18 Claims, 2 Drawing Sheets

CONFORMAL FARADAY EFFECT ANTENNA

FEDERALLY-SPONSORED RESEARCH AND DEVELOPMENT

The Conformal Faraday Effect Antenna is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email ssc_pac_T2@navy.mil, reference Navy Case No. 100447.

BACKGROUND

There is a strong need for conformal antennas. Conformal antennas are located very close to a surface, typically a small fraction of a wavelength. Usually, this surface is made of conductive metal. One example of a conductive metal surface is the outer skin of an aircraft, where a conformal antenna would be placed. The conformal shape of the antenna permits it to operate without disturbing the aerodynamics of the aircraft.

Conformal antenna design is limited by the conducting ground plane. A conducting surface tends to reduce the RF electromagnetic fields transmitted or received by any antenna placed close to and oriented tangentially to it. Another way to understand this is to replace the infinite perfect conductor with an image antenna. The two antennas will constructively interfere if the spacing is one-half a wavelength. If the spacing is a small fraction of a wavelength, the radiation destructively interferes, due to the fact that when the waves are reflected from the ground plane they undergo a 180 degree phase shift. Thus, if the distance between the antenna element and ground plane is a small fraction of a wavelength, the waves coming directly from the antenna element and those reflected from the ground plane will nearly cancel. A need exists for a conformal antenna that prevents the cancellation of waves coming directly from the antenna element.

SUMMARY OF SOME EMBODIMENTS

Some embodiments of the Conformal Faraday Effect Antenna comprise an antenna element directly coupled to a layer of gyrotropic material and means for creating a magnetic field, the magnetic field having a component substantially perpendicular to, and passing through, the layer of gyrotropic material and the antenna element. The gyrotropic material may be at least partially disposed on a ground plane, and may comprise a material such as yttrium iron garnet. The means for creating a magnetic field can be within the layer of gyrotropic material and may comprise at least one magnet. The ground plane may be comprised of reflective metal, and may be the outer surface of a vehicle. The antenna element may have a dipole antenna configuration, and can produce a wave that is linearly polarized. The gyrotropic material can be saturated by the magnetic field to maximize the rotation of the polarization and minimize absorption of RF energy caused by any hysteresis of the gyrotropic material. The operation of the device may be below, at, or above the resonant frequency of the gyrotropic material.

DETAILED DESCRIPTION OF SOME EMBODIMENTS

Figure 1A:
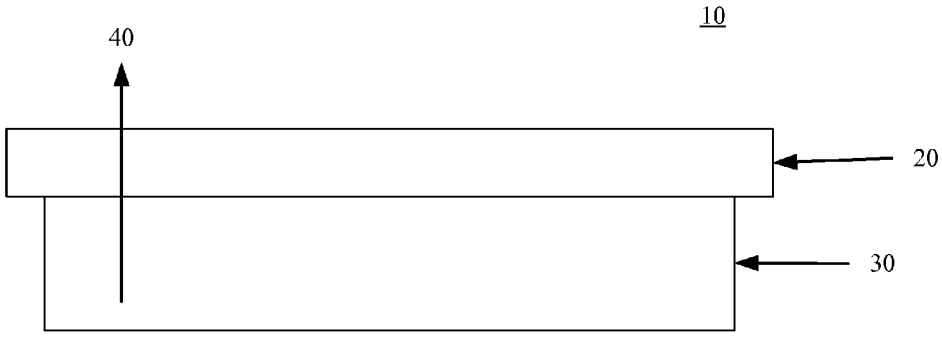
FIGS. 1A-1C show side and top views of an embodiment of the Conformal Faraday Effect Antenna device.

FIG. 1 shows a side view of the Conformal Faraday Effect Antenna device 10. Device 10 includes an antenna element 20 directly coupled to a layer of gyrotropic material 30. A magnetic field 40 is created by a means for creating a magnetic field. Magnetic field 40 has a component substantially perpendicular to, and passing through, the layer of gyrotropic material 30 and antenna element 20. In some embodiments, means for creating a magnetic field 40 may be within the layer of gyrotropic material 30. As an example, means for creating a magnetic field 40 may be the gyrotropic material 30 itself, provided a magnetic gyrotropic material is used. In other embodiments, means for creating a magnetic field 40 may be one or more magnets (see FIGS. 2 and 3). Layer of gyrotropic material 30 may comprise, for example, yttrium iron garnet. Gyrotropic material 30 may be saturated by the magnetic field 40 to produce the maximum possible rotation of polarization and to minimize absorption of RF energy caused by the hysteresis, if any, of the gyrotropic material 30, in some embodiments.

Figure 1B:
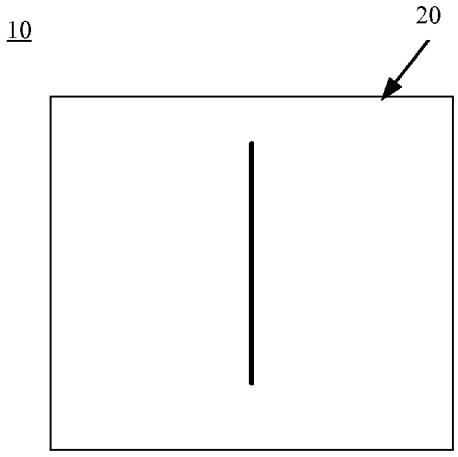
Figure 1C:
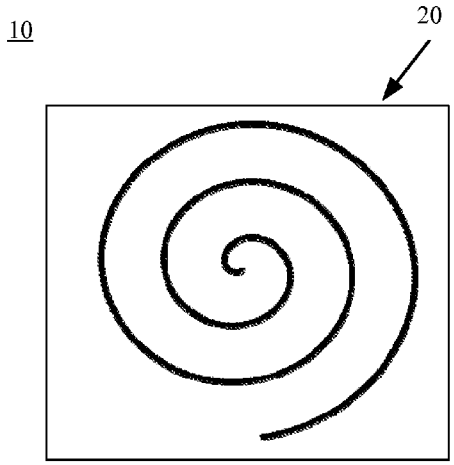

Antenna element 20 may have a dipole configuration, as shown in FIG. 1B. In some embodiments, antenna element 20 may have a different configuration, such as a spiral configuration, as shown in FIG. 1C. Further, in some embodiments, antenna element 20 may produce a linearly polarized wave. In other embodiments, antenna element 20 may produce a wave having a circular or elliptical polarization. Device 10 may operate below, at, or above the resonant frequency of gyrotropic material 30.

In some embodiments, there may be an insulating layer, positioned between and coupled to, antenna element 20 and layer of gyrotropic material 30. A standard insulating material is recognized by one having ordinary skill in the art.

Figure 2:
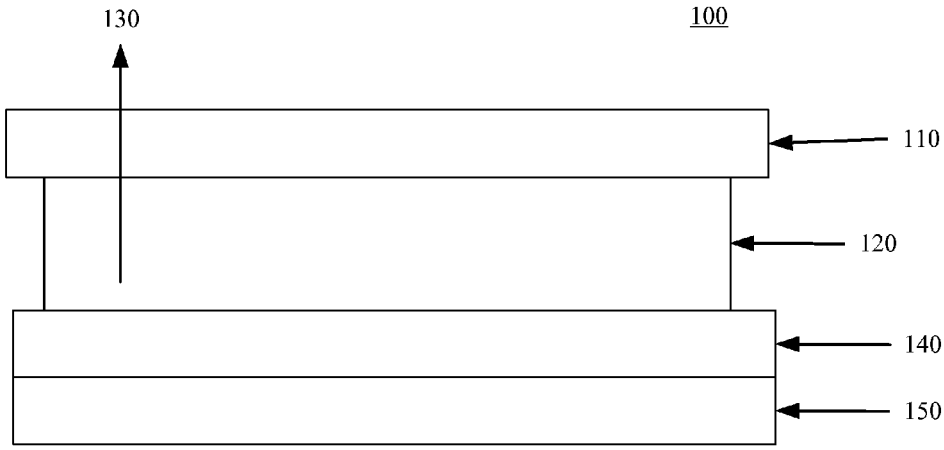
FIG. 2 shows a side view of another embodiment of the Conformal Faraday Effect Antenna device.

FIG. 2 shows a side view of another embodiment of a Conformal Faraday Effect Antenna device 100. Device 100 may include a layer of gyrotropic material 120 disposed on one side of a ground plane 140, an antenna element 110 disposed on layer of gyrotropic material 120, and means 150 for creating a magnetic field 130 coupled to the other side of ground plane 140. Magnetic field 130 has a component substantially perpendicular to, and passing through, the layer of gyrotropic material 120 and antenna element 110. Gyrotropic material 120 may be at least partially disposed on a ground plane 140, which may be a reflective metal surface. In some embodiments, means 150 for creating a magnetic field 130 comprises at least one magnet. In other embodiments, means 150 for creating a magnetic field 130 may comprise a coil carrying an electric current. In some embodiments, layer of gyrotropic material 120 may comprise yttrium iron garnet. Antenna element 110 may have a dipole configuration and may produce a linearly polarized wave. The device 100 may operate at or above the resonant frequency of layer of gyrotropic material 120, which may be saturated by magnetic field 130.

In some embodiments, means 150 for creating a magnetic field 130 is placed under ground plane 140, to generate magnetic field 130 perpendicular to layer of gyrotropic material 120. Such a configuration causes layer of gyrotropic material 120 to rotate the polarization of the waves passing down from antenna element 110 to ground plane 140 via the Faraday effect. The waves then reflect from ground plane 140 and make a second passage upward through layer of gyrotropic material 120, where they undergo a second rotation of their polarization in the same direction. The two rotations of the polarization during the passages downwards and upwards through layer of gyrotropic material 120 are additive. These rotations of the polarizations of the reflected waves cause them to propagate away from antenna element 110 with a different polarization than the waves coming directly from antenna element 110. Thus, the reflected and direct waves do not cancel each other.

The Faraday effect rotates the linear polarization of an incident electromagnetic wave. Magnetic field 130 causes the electrons in layer of gyrotropic material 120 to rotate an incident linear polarized electromagnetic wave, provided the direction of propagation is parallel to magnetic field 130. The direction of rotation depends on the direction of propagation and magnetic field 130. Layer of gyrotropic material 120, between antenna element 110 and ground plane 140, with magnetic field 130 perpendicular to layer of gyrotropic material 120, will rotate an incident linear polarization. The angle of rotation, θ, is calculated from the following formula:

$$\frac{\theta}{l} = 4\pi M_S \gamma * \frac{\sqrt{\frac{|\varepsilon| + \varepsilon'}{2}}}{2c}$$

where $4\pi M_s$ is the saturation magnetization, γ is the gyromagnetic ratio, c is speed of light and ∈ is the dielectric constant and ∈' is the real part, and l is the thickness of the layer of gyrotropic material 120. For gyrotropic material 120 at magnetic saturation, the above equation is valid above its resonant frequency. This equation is independent of frequency above the resonance of the material. The resonance frequency depends on the internal and external magnetic fields.

The angle of rotation, θ, for the gyrotropic layer is given by the above equation. The reflection from the ground plane 140 adds an additional 180 degree rotation. The waves reflected back from ground plane 140 and passing through layer of gyrotropic material 120 a second time in the opposite direction will also be rotated by the same angle so that the Faraday effect rotation does not cancel itself out on reflection. If θ=45 the reflected wave from an antenna will be shifted to an orthogonal polarization, θ=270. The saturated Faraday effect is independent of frequency. In some embodiments, the layer of gyrotropic material 120 may be used as a selective absorber for either right or left circular polarizations. The angle of rotation may not be exactly 90 degrees, depending on the parameters in the equation. In some embodiments, layer of gyrotropic material 120 may not be saturated.

As an example, layer of gyrotropic material 120 may comprise G1010, manufactured by Trans-Tech Inc., a subsidiary of Skyworks Solutions, Inc. The saturation field for the G1010 is approximately 800 gauss. In the present example, $4\pi M_s$=1000, γ=1.99, ∈'=14.7 and ∈"=0.003 (loss tangent t=0.0002). The thickness for 45 degree rotation is 7 mm. Twenty five rare earth magnets may be placed in a square array to provide a 1000 gauss field. A dipole may be constructed from two disks, diameter 1.227", with a coaxial cable feed. The dipole may be placed over the G1010.

$S_{11}$ is a standard measurement used in the microwave industry to determine how effectively an antenna is radiating or absorbing the RF energy being fed into it. $S_{11}$ measurements may be performed to determine the radiation effectiveness of the previously described disk dipole antenna for four configurations: 1) when it is placed on the layer of G1010 with the magnetic field applied; 2) when it is placed on the layer of G1010 without the magnetic field; 3) when it is placed ¼" above the conductive ground place without the G1010 layer; and 4) when it is located in free space.

Antenna gain pattern measurements may also be performed on these four antenna configurations. In the present example, comparing the $S_{11}$ and gain values for these four configurations, the antenna pattern measurements show that the Faraday effect rotates the antenna polarization, and the Conformal Faraday Effect Antenna performs as well as the free space dipole of configuration 4 above 1.5 GHz.

Figure 3:
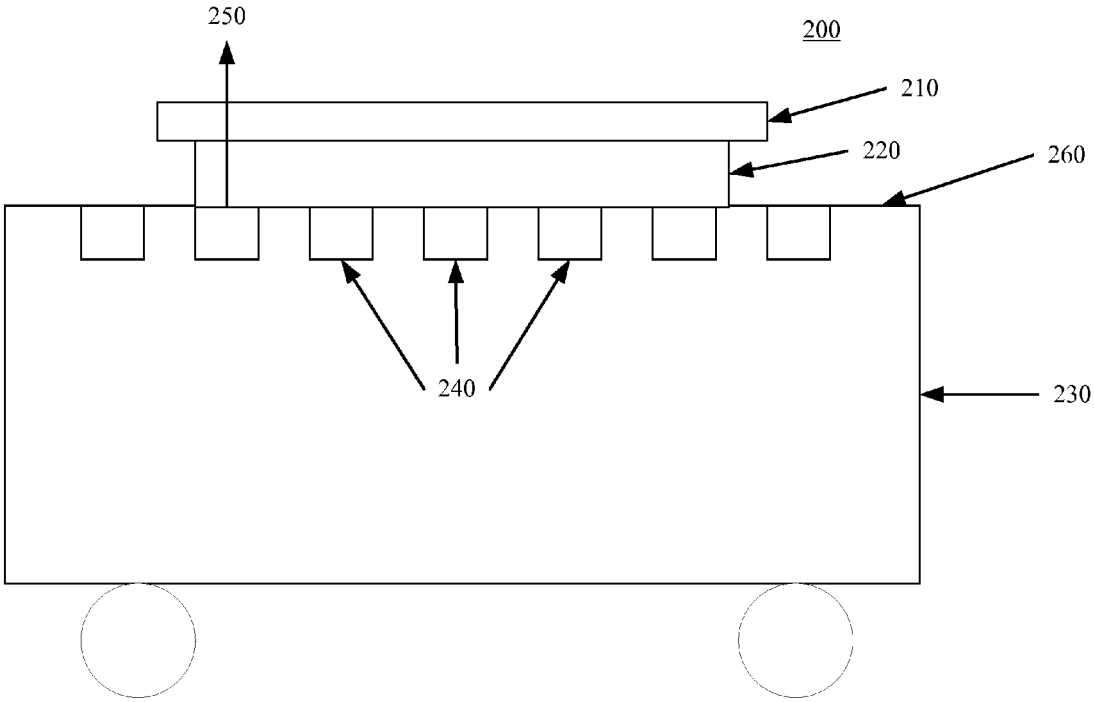
FIG. 3 shows a side view of an embodiment of the Conformal Faraday Effect Antenna device employing the roof of a vehicle as a ground plane.

FIG. 3 shows a side view of a Conformal Faraday effect Antenna device 200 wherein ground plane 260 is the outer surface of a vehicle 230. In some embodiments, vehicle 230 may be a land vehicle. In other embodiments, vehicle 230 may be an aircraft or ship. Device 200 comprises a layer of gyrotropic material 220 disposed on one side of a ground plane 260, an antenna element 210 disposed on the layer of gyrotropic material 220, and means 240 for creating a magnetic field 250 coupled to the other side of ground plane 260. Magnetic field 250 has a component substantially perpendicular to, and passing through, layer of gyrotropic material 220 and antenna element 210. Layer of gyrotropic material 220 may be at least partially disposed on a ground plane 260 and means 240 for creating magnetic field 250 comprise at least one magnet 240. In some embodiments, layer of gyrotropic material 220 may comprise yttrium iron garnet. Antenna element 210 may have a dipole configuration, and may produce a linearly polarized wave. Device 200 may operate at, below, or above the resonant frequency of gyrotropic material 220, which can be saturated by magnetic field 250.

Many modifications and variations of the Conformal Faraday Effect Antenna device are possible in light of the above description. Therefore, within the scope of the appended claims, the Conformal Faraday Effect Antenna device may be practiced otherwise than as specifically described. Further, the scope of the claims is not limited to the embodiments disclosed herein, but extends to other embodiments as may be contemplated by those with ordinary skill in the art.

We claim:

1. A device comprising:

an antenna element directly coupled to a layer of gyrotropic material at least partially disposed on a ground plane; and means for creating a magnetic field having a component substantially perpendicular to, and passing through, the layer of gyrotropic material and the antenna element.

2. The device of claim 1, wherein the means for creating a magnetic field is contained within the layer of gyrotropic material.

3. The device of claim 1, wherein the ground plane is the outer surface of a vehicle.

4. The device of claim 3, wherein the vehicle is an aircraft.

5. The device of claim 1, wherein the layer of gyrotropic material comprises yttrium iron garnet.

6. The device of claim 1, wherein the means for creating a magnetic field comprises at least one magnet.

7. The device of claim 1, wherein the antenna element has a dipole antenna configuration.

8. The device of claim 1, wherein the antenna element produces a wave that is linearly polarized.

9. The device of claim 1, wherein the gyrotropic material is saturated by the magnetic field.

10. The device of claim 1, wherein the device operates above the resonant frequency of the gyrotropic material.

11. A device comprising:

a layer of gyrotropic material disposed on one side of a ground plane;

an antenna element disposed on the layer of gyrotropic material; and means for creating a magnetic field coupled to the other side of the ground plane, the magnetic field having a component substantially perpendicular to, and passing through, the layer of gyrotropic material and the antenna element.

12. The device of claim 11, wherein the ground plane is the outer surface of a vehicle and comprises a reflective material.

13. The device of claim 11, wherein the layer of gyrotropic material comprises yttrium iron garnet.

14. The device of claim 11, wherein the means for creating a magnetic field comprises at least one magnet.

15. The device of claim 11, wherein the antenna element has a dipole antenna configuration.

16. The device of claim 11, wherein the antenna element has a spiral antenna configuration.

17. The device of claim 11, wherein the antenna element produces a wave that is linearly polarized.

18. A device comprising:

a layer of gyrotropic material positioned between and coupled to a ground plane and an antenna element, the ground plane positioned between and coupled to the layer of gyrotropic material and at least one magnet.

* * * * *

UNITED STATES PATENT AND TRADEMARK OFFICE

CERTIFICATE OF CORRECTION

PATENT NO. : 8,368,615 B1
APPLICATION NO. : 12/861128
DATED : February 5, 2013
INVENTOR(S) : David Brock and Thomas O. Jones, III It is certified that error appears in the above-identified patent and that said Letters Patent is hereby corrected as shown below:

Title page, item [75] inventor should read – David Brock –

Signed and Sealed this
First Day of July, 2014

Michelle K. Lee

Michelle K. Lee
*Deputy Director of the United States Patent and Trademark Office*